US005769438A

United States Patent [19]

Svetlov

[11] Patent Number: 5,769,438

[45] Date of Patent: Jun. 23, 1998

[54] SKATEBOARD

[76] Inventor: Felix Svetlov, 2977 W. 33 St., #15C, Brooklyn, N.Y. 11224-1401

[21] Appl. No.: 746,600

[22] Filed: Feb. 19, 1997

[51] Int. Cl.[6] ..... B62M 1/00

[52] U.S. Cl. ..... 280/87.041

[58] Field of Search ..... 280/603, 612, 280/87.01, 87.021, 87.041, 87.042, 87.05

[56] References Cited

U.S. PATENT DOCUMENTS

| | | | |
|---|---|---|---|
| 3,437,345 | 4/1969 | Berta | 280/612 |
| 3,667,771 | 6/1972 | Larson | 280/612 |
| 4,161,326 | 7/1979 | Gaber | 280/87.042 |
| 4,358,130 | 11/1982 | Adams | 280/603 |
| 4,458,907 | 7/1984 | Meredith | 280/87.05 |
| 5,020,821 | 6/1991 | Leroy | 280/603 |

FOREIGN PATENT DOCUMENTS

| | | | |
|---|---|---|---|
| 2012474 | 10/1971 | Germany | 280/612 |
| 3319889 | 12/1984 | Germany | 280/603 |
| 988304 | 1/1983 | U.S.S.R. | 280/603 |

*Primary Examiner*—Brian L. Johnson
*Assistant Examiner*—Frank Vanaman

[57] ABSTRACT

A wheeled skateboard consists of first, second and third separate sections, so that said first and second sections are foldably connected to the third section. A lock is provided at the bottom of the platform. The lock includes a pair of cylindrical rods. Each rod has first and second ends, wherein each first end is pivotally connected to the first platform section. A pair of receiver elements is located within the third platform section. The skateboard occupies one of a folded unlocked position and extended locked position wherein, in the extended locked position, each rod is received within the pair of receiving elements and the respective ends of the pair of rods are connected to each other by a spring.

6 Claims, 2 Drawing Sheets

SKATEBOARD

FIELD OF THE INVENTION

This invention relates to sport equipment, and more particularly, it relates to skateboards.

BACKGROUND OF THE INVENTION

Skateboards or roller boards consisting of a platform having front and rear rollers situated underneath the platform are well known in the art. However, in view of unsatisfactory engagement between the surface of the board and the shoes of a skater, use of such skateboards can be dangerous. Furthermore, such prior art skateboards are cumbersome and inconvenient in transportation.

One example of the skateboard is provided in USSR Inventor Certificate No. 1,375,264. This skateboard includes a platform provided with spherical rollers and is formed even with fewer safety features than the skateboard described hereinabove. Further examples of the skateboards are provided in the following U.S. Pat. Nos. : 3,992,025 to Amelio; 3,436,088 to Kunselman; 4,133,546 to Rosenblum. These skateboards are not formed with elementary safety features so as to prevent accidents leading to injuries and sometimes death of a skater.

SUMMARY OF THE INVENTION

One aspect of the invention provides a wheeled skateboard and shoe attachment system. The skateboard consists of a platform with top and bottom surfaces, wherein the platform includes first, second and third separate sections and the first and second sections are foldably connected to the third section. A lock is located at the bottom surface of the platform and includes a pair of cylindrical rods. Each rod is formed having first and second ends and each first end is pivotably connected to the first platform section. A pair of receiver elements is situated in the third platform section. The skateboard occupies one of a folded unlocked position and an extended locked position. In the extended locked position, each rod is received with one of the receiver elements and the second ends of the pair of rods are connected to each other by a spring, so that three separate sections of the platform are coplanar with one another. The shoe attachment system consists of a plurality of magnetic elements recessed within the top surface of the platform and a plurality of magnetically attractable elements having polarity opposite to the polarity of the magnetic elements. The plurality of magnetically attractable elements is recessed within the sole of a skater's shoe. In use, the plurality of magnetic elements and the plurality of magnetically attractable elements are magnetically attracted to one another coupling said skater's shoe to the top surface of the platform.

According to a further aspect of the invention, the plurality of magnetic elements is situated at least within the first and third sections of the platform and the pair of cylindrical rods extends longitudinally along the edges of the platform.

As to another aspect of the invention, a plurality of magnetically attractable elements can be either a plurality of metal members or a plurality of magnets situated within the sole of the skater's shoe.

DESCRIPTION OF THE PREFERRED EMBODIMENT

Figure 1:
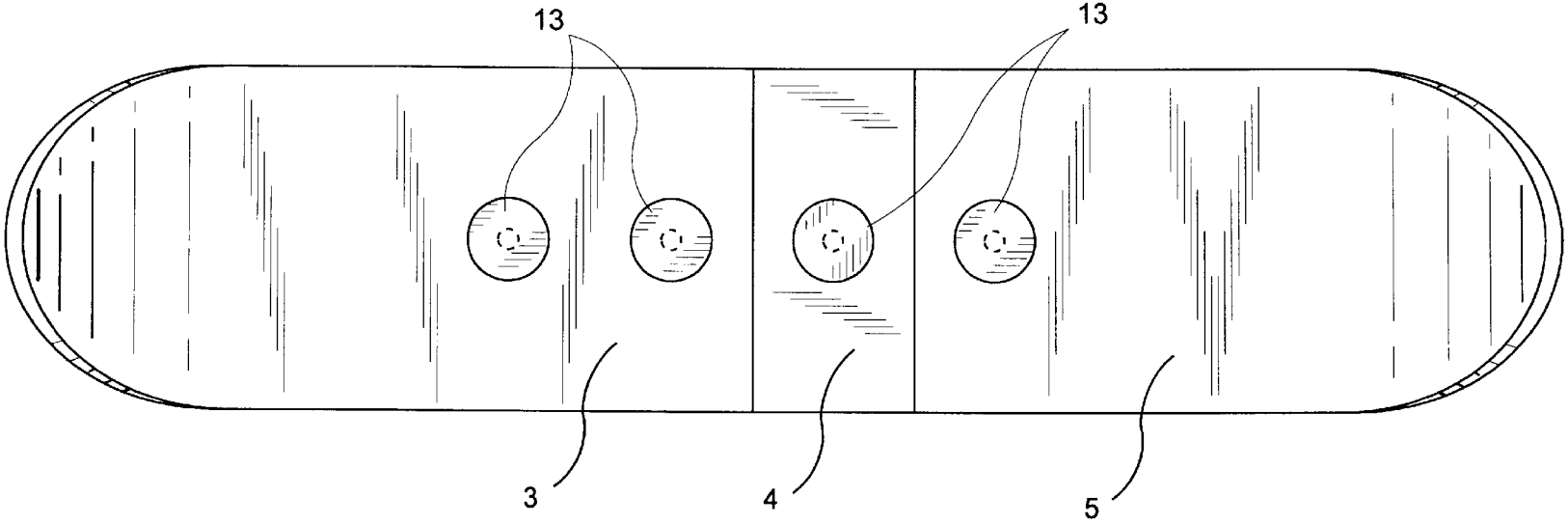
FIG. 1 is a top plan view of the skateboard.
Figure 2:
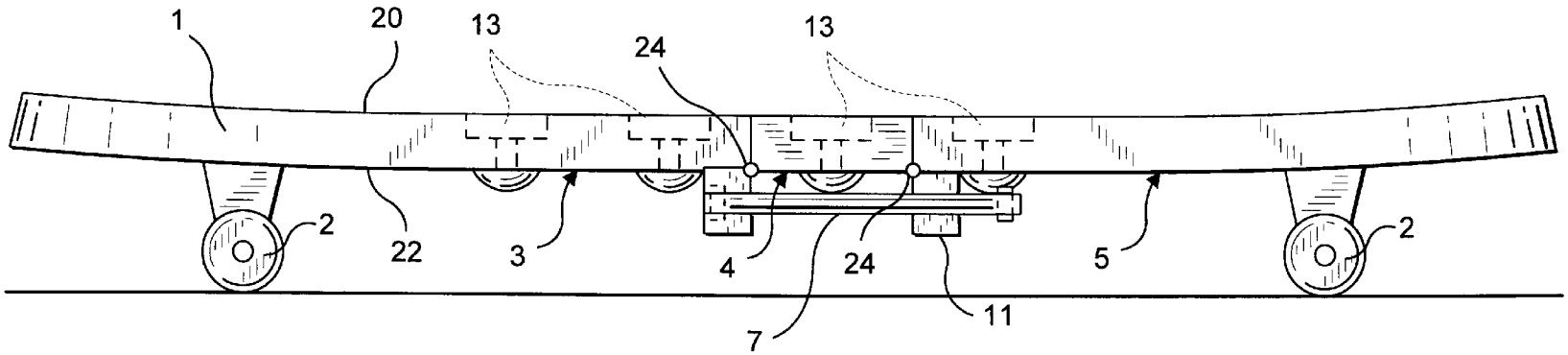
FIG. 2 is a side elevational view thereof.
Figure 3:
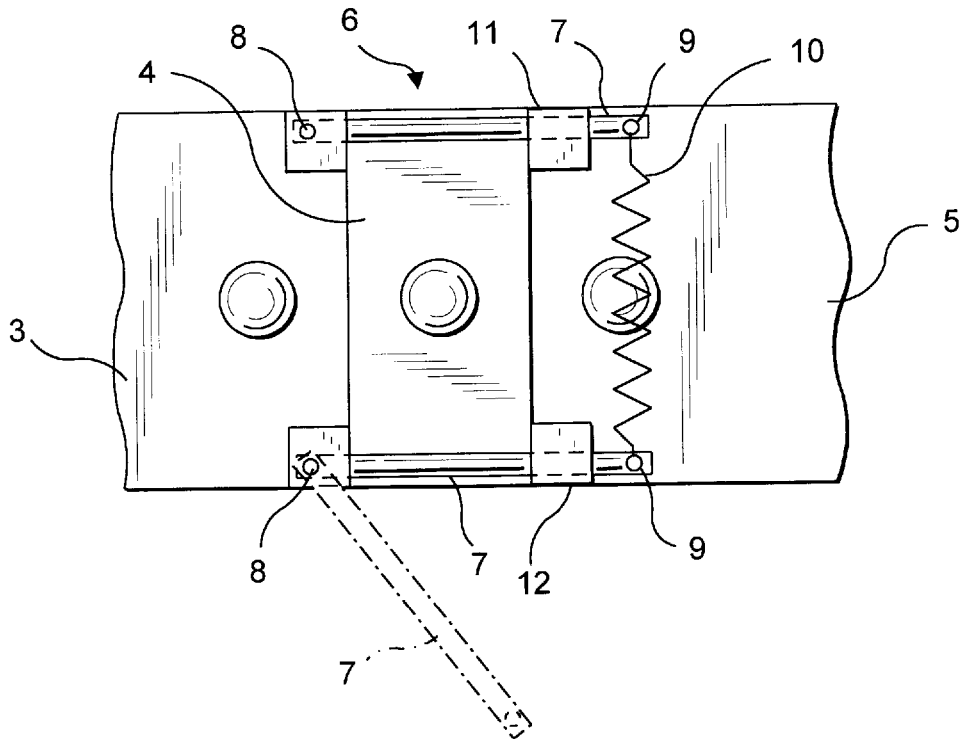
FIG. 3 is a bottom view of a central portion of the platform.

As best illustrated in FIGS. 1–3, the skateboard of the invention consists of a platform 1 having a top 20 and bottom 22 surface. Front and rear roller assemblies 2 are attached to the bottom surface 22 of the skateboard. The platform 1 is formed having a first section 3, a second section 5 and a middle or third section 4 interposed therebetween. The first and second sections are foldably connected to the third section by means of joints 24. A pair of receiver elements 11 and 12 are provided at the second section 5 of the platform.

The skateboard occupies one of folded, unlocked position and extended, locked position. A lock assembly 6 is provided at the bottom surface 22 of the platform. As clearly illustrated in FIG. 3, the lock assembly 6 consists of two cylindrical rods 7. Each cylindrical rod 7 extends between respective first end 8 and second end 9. The first end 8 of each rod is pivotally connected to the first platform section 3. In the extended or locked position of the platform, the second ends 9 of the rods are interconnected by a spring 10. The lock assembly is equipped with fixing pins providing rigid securement of the rods in the extended position of the invention. In the locked position each rod is received in the corresponding receiver element.

Figure 4:
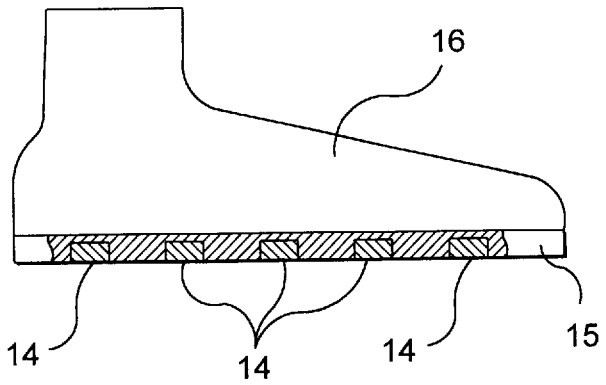
FIG. 4 is a schematical view of a shoe of a skater.

As illustrated in FIGS. 1 and 2, a plurality of magnetic elements 13 is recessed within the top surface 20 of the platform. These magnetic elements are adapted for interconnection with a plurality of magnetically attractable elements 14 forming a part of a sole 15 of shoes 16 of a skater. As illustrated in FIG. 4, the plurality of magnetically attractable elements 14 is recessed within a sole of the skater's shoes. These elements are formed having magnetic polarity opposite to that of the magnetic elements 13 of the skateboard. In the preferred embodiment of the invention, the magnetically attractable elements 14 are the magnets provided in the shoes 16 of the skater. However, magnetically attractable elements 14 in the shoes of a skater can be also made as metal plates capable of magnetic engagement with the plurality of magnetic elements of the skateboard.

Prior to assembly of the skateboard of the invention, sections 3, 4 and 5 of the platform are placed in a substantially coplanar position. Then, the cylindrical rods 7 of the lock assembly 6 are positioned within the receiver elements 11 and 12, and the second ends 9 of the cylindrical rods are connected by the spring 10. In use, the shoes 16 of a rider have to be placed in the center of the platform alongside its edges. In this condition, the stationary magnets 13 of the platform interact with the magnetically attractable elements 14 situated within the sole, so as to provide secure coupling of the shoes with the platform.

To place the skateboard into the folded or unlocked position, the spring 10 is released from its engagement with the second ends 9 of the rods 7. Then the rods 7 of the lock assembly 6 are removed from their engagement with the receiver elements 11 and 12 facilitating folding of the platform.

Thus, the present invention provides the skateboard with the platform consisting of three separate sections 3, 4 and 5, interconnected by the joints 24 and having the lock assembly positioned underneath the platform which consists of two substantially cylindrical rods 7. One end of each rod is connected to the platform through a pivotal joint and the other ends of the rods are adapted to be connected by a spring in the locked or extended position of the skateboard. The upper surface of the platform contains stationary magnets adapted for interaction with the magnetically attractable elements forming a part of the shoes of a skater.

What is claimed is:

1. A wheeled skateboard and shoe attachment system comprising:

a skateboard consisting of a platform with top and bottom surfaces; said platform comprising first, second and third separate sections, said first and second sections foldably connected to the third section;

a lock; said lock located at said bottom surface of said platform, said lock including a pair of cylindrical rods, each said rod having first and second ends, each said first end pivotably connected to the first section of the platform;

a pair of receiver elements located at said second platform section;

said skateboard occupies one of a folded unlocked position and an extended locked position;

in said extended locked position each said rod is received in one of said pair of receiver elements, the respective second ends of said pair of rods connected to each other by a spring and said three separate sections of the platform being coplanar with one another;

said wheeled skateboard and shoe attachment system including:

a plurality of magnetic elements recessed within said top surface of said platform, a plurality of magnetically attractable elements having polarity opposite to the polarity of said plurality of magnetic elements, said plurality of magnetically attractable elements recessed within a sole of a skater's shoe;

wherein in use said plurality of magnetic elements and said plurality of magnetically attractable elements are magnetically attracted to one another, coupling said skater's shoe to said top surface of said platform.

2. The wheeled skateboard and shoe attachment system of claim 1, wherein said pair of cylindrical rods extends longitudinally along edges of said platform.

3. The wheeled skateboard and shoe attachment system of claim 1, wherein said plurality of magnetically attractable elements is a plurality of metal members situated within the sole of the skater's shoe.

4. The wheeled skateboard and shoe attachment system of claim 1, wherein said plurality of magnetically attractable elements is a plurality of magnets situated within the sole of the skater's shoe.

5. A wheeled skateboard, comprising:

a platform having top and bottom surfaces, said platform comprising first, second and third separate sections, said third section being interposed between said first and second sections in such a manner that said first and second sections are foldably connected to the third section;

a lock, said lock located at said bottom surface of the platform, said lock, including a pair of cylindrical rods, each said rod having first and second ends, each said first end pivotably connected to the first platform section; and a pair of receiver elements located within said second platform section;

wherein said skateboard occupies one of a folded unlocked position and an extended locked position, so that in said extended locked position each said rod is received with said pair of receiving elements, the respective second ends of said pair of rods are connected to each other by a spring and said three separate platform sections being coplanar with one another.

6. The wheeled skateboard of claim 5, further comprising a plurality of magnetic elements recessed within said top surface of the platform, said plurality of magnetic elements being adapted to be attracted to a plurality of magnetically attractable elements situated within a sole of a skater's shoe and having polarity opposite to the polarity of said plurality of magnetic elements, so that said top surface of the platform being adapted to magnetically couple the skater's shoe thereto.

* * * * *